US005497838A

United States Patent [19]

McCannon, Jr. et al.

[11] Patent Number: 5,497,838

[45] Date of Patent: Mar. 12, 1996

[54] AUTOMATED ROCK BURNER

[76] Inventors: W. Allen McCannon, Jr., 2168 Jaudon Rd.; Dan W. Dye, 1619 Calhoun Falls Hwy.; Cecil F. Bond, 1143 Athens Hwy., all of Elberton, Ga. 30635

[21] Appl. No.: 425,655

[22] Filed: Apr. 20, 1995

[51] Int. Cl.[6] ..... E21B 7/14; E21B 19/08; E21B 44/00; E21C 37/16

[52] U.S. Cl. ..... 175/27; 175/14; 175/122; 175/162; 431/158

[58] Field of Search ..... 175/11–17, 27, 175/122, 162, 203, 4; 431/157, 158; 299/14

[56] References Cited

U.S. PATENT DOCUMENTS

| | | | |
|---|---|---|---|
| 2,679,381 | 5/1954 | Royer et al. | 175/14 |
| 3,245,721 | 4/1966 | Margiloff | 175/16 X |
| 3,608,967 | 9/1971 | Vasellin | 175/16 X |
| 3,658,453 | 4/1972 | Vasselin | 431/158 |
| 4,319,647 | 3/1982 | Browning | 175/14 |
| 5,107,937 | 4/1992 | Yeargin et al. | 175/27 |
| 5,211,156 | 5/1993 | Jurewicz et al. | 175/14 X |

OTHER PUBLICATIONS

Dimensional Stone Ned–Jet 2000 vol. 11, No. 2 Feb. 1995 p. 38.

*Primary Examiner*—Stephen J. Novosad
*Attorney, Agent, or Firm*—Henry S. Jaudon; Cort Flint

[57] ABSTRACT

An automated burner system for channeling a mineral body consisting of a burner staff carrying a burner at one end, a guide shaft adapted to carry the burner staff for reciprocating motion, a support shaft adapted to mount the guide shaft for oscillating motion, and a carriage adapted to carry said support shaft. A carrying frame is provided to carry the carriage for longitudinal movement. A first drive provides positive reciprocal movement of the burner staff, a second drive provides positive oscillating movement for the guide shaft and the burner staff, and a third drive provides positive longitudinal movement of the carriage along the carrying frame. An electronic control is connected with the first, second and third drives. The electronic control includes a repeating program which controls the burner staff to move a desired distance in each direction of reciprocal movement, the burner staff to oscillate at a prescribed angle and through a prescribed length of oscillation.

23 Claims, 4 Drawing Sheets

AUTOMATED ROCK BURNER

BACKGROUND OF THE INVENTION

This invention relates to an automated burner system for channeling mineral bodies such as granite or marble.

The act of using hand held burners for channeling in granite or marble quarries is well known. The process requires a minimal of expense in equipment cost, however, the process is labor intensive and is slow and time consuming.

Channeling with hand burners to date is the best method of preparing or forming blocks of stone for removal from the granite shelves.

The major drawback to using hand held burners is the proximity of the operator to the burner. In operation, these burners create a noise level of as much as .126 decibels. Exposure to noise at this level has been found to cause severe health problems. As a result, the U. S. Bureau of Mines has mandated that the noise level at which an operator may be exposed to can not exceed 0.95 decibels or that the operator must be at least fifteen feet from an operating burner.

That have been several attempts to develop an automated burner system, none of which to date have satisfactorily duplicated the oscillating and reciprocating motion of the operator and simultaneously protecting the channeled surface from over burn.

There is an undocumented device which utilizes a plurality of pistons and cable assemblies to create the necessary motions of the burner head. There is another arrangement taught in U.S. Pat. No. 5,107,937 which utilizes a plurality of electric motors, clutches and cable assemblies to create the necessary burner head motion. These devices, while being marginally satisfactory in function, have been found to be extremely costly to operate due to down time caused by breakdown of the drive assemblies. They also are not sufficiently sensitive to eliminate heat cracks in the granite.

Another known channeling device is described in dimensional Stone, February 1995. This device, which is also automated, uses a water jet for channeling. The device is extremely costly to operate and is slow and time consuming.

Accordingly, it is an object of this invention to provide an automated channeling device which is cost effective.

Another object of the invention is to provide an automated burner system which is efficient in its ability to burn rock and yet sensitive to prevent heat cracks in the rock.

Another object of the invention is the provision of a burner system which is easily transportable and easily set up for operation.

Another object of the invention is the provision of a drive system which positively drives the burner staff through all of its operational motions.

Another object of the invention is to provide an automated burner system which is controlled by an electronic control system through repeating cycles of operation.

Another object of the invention is a combination burner system which may operate automatically or be directed through its motion cycles by an operator controlling a hand held control panel.

SUMMARY OF THE INVENTION

An automated burner system comprising a burner staff carrying a burner at one end; a guide shaft adapted to carry the burner staff for reciprocating motion; and a support shaft which mounts the guide shaft for oscillating motion. A carriage is provided to support the support shaft, guide shaft and burner staff for longitudinal movement.

A carrying frame having a pair of spaced parallel rails is provided to support the carriage for longitudinal movement.

An electronic control is mounted on the carriage and is connected with a first drive, a second drive and a third drive. The electronic control includes a repeating program which activates the first drive to move the burner staff a desired distance in each direction of reciprocal movement, activates the second drive to oscillate said burner staff at a prescribed angle and through a prescribed length of oscillation, and activates the third drive to move the carriage carrying the burner staff longitudinally along the carrying frame upon completion of one cycle of reciprocating and oscillating movements whereby the burner system operates in an automatic continuous and repetitive manner. The electronic control is mounted on the carriage.

A hydraulic system is provided to drive the first, second and third drives. The hydraulic system, which is also carried by the carriage, includes a hydraulic pump and a plurality of flow valves.

The first drive, the second drive and the third drive each comprise a hydraulic motor having a rotably driven drive gear. The hydraulic motors are connected with and driven by the hydraulic system.

The carrying frame is rectangular in shape and includes a pair of rails united with spaced cross members. There are a plurality of wheels which allow for ease of movement when the system is not operational. There are also a plurality of support pods which stably support the carrying frame in a horizontal manner when the system is operation. The pods are normally in an elevated position when the system is not operation and extend below the wheels to elevate them and support the carrying frame when the system is operational. The pods are arranged adjacent each corner of the carrying frame and includes a vertically adjustable member for horizontally adjusting the carrying frame.

The vertically adjustable member carrying the pods comprises a hydraulic cylinder having a vertically movable piston mounting a shoe on its exposed end. A control system including a hydraulic supply and a control valve are connected with each hydraulic cylinder. This arrangement allows for vertical adjustment of the pod carrying piston within the cylinder.

The third drive includes a rack carried by the carrying frame and engaged with a drive gear for facilitating longitudinal movement of the carriage along the carrying frame.

The electronic control includes a manual control panel which is capable of interrupting the repeating program, and providing for manual control of the reciprocating, oscillating and longitudinal motions of the system.

There are a plurality of proximity switches incorporated into the electronic control. The proximity switches are positioned to monitor the first, second and third drives and are operative to actuate the electronic control to control the first, second and third drives through their programmed movements.

The support shaft, guide shaft, and burner staff are carried by a burner housing which is mounted on a pair of rods carried by the carriage. The burner housing is located adjacent selected ends of the rods during operation. The burner housing is capable of being vertically mounted during operation and of being positioned at between 30° and 50° during movement.

The electronic control includes a pressure sensing system connected with the first drive which is activated upon sensing excessive pressure against the first drive during reciprocal movement of the burner staff. The pressure sensing system is operative to signal the electrical control to move the first drive to elevate the burner staff and simultaneously to activate the third drive to move the carriage rearward one increment. The electronic control then activates the first drive and the third drive to begin anew the cycles of motion.

An automated burner system for channeling a mineral body comprising a carriage carrying a burner assembly, a hydraulic system and an electronic control system connected with the burner assembly and the hydraulic system. The burner assembly includes a burner staff and a staff guide which is adapted to carry the staff for reciprocal vertical movement. A staff drive motor which is rotatable in first and second directions operates to reciprocally drive the staff between vertically spaced upper and lower limits. A carriage drive motor also rotatable in first and second directions said carriage drive motor drives the carriage incrementally in forward and rearward directions. A proximity switch is connected with the electronic control system and is arranged to scan the staff drive motor. The switch functions to control the direction of the staff drive motor between its first and second directions of rotation by counting the revolutions thereof.

The system functions in normal operation with the staff drive motor rotating in the first and second direction to move the staff between lower and upper limits. The proximity switch counts revolutions of the staff motor in each direction through a prescribed number of revolutions and signals the electronic control. The electronic control operates to reverse motor direction of the staff motor after completion of the prescribed number of revolutions. The electronic control system also activates the carriage motor through an increment of forward drive upon the staff cycling through an upper and lower limit of motion.

A switch is further provided to signal the electronic control system to reserve the direction of drive of the staff motor to return the staff to its upper or lower limit upon an indication of the staff drive motor stalling and failing to reach the prescribed number of revolutions. Upon return of the staff to its upper or lower limit the electronic control systems reactive the staff drive motor to again move the staff between its upper and lower limits. The electronic control system is operative to deactivate the system upon receiving consecutive indications that the staff drive motor failed to reach the prescribed number of revolutions.

The burner system is designed to use fuel consisting of oxygen, diesel fuel and water, although it could also function with other known fuels such a diesel and water.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
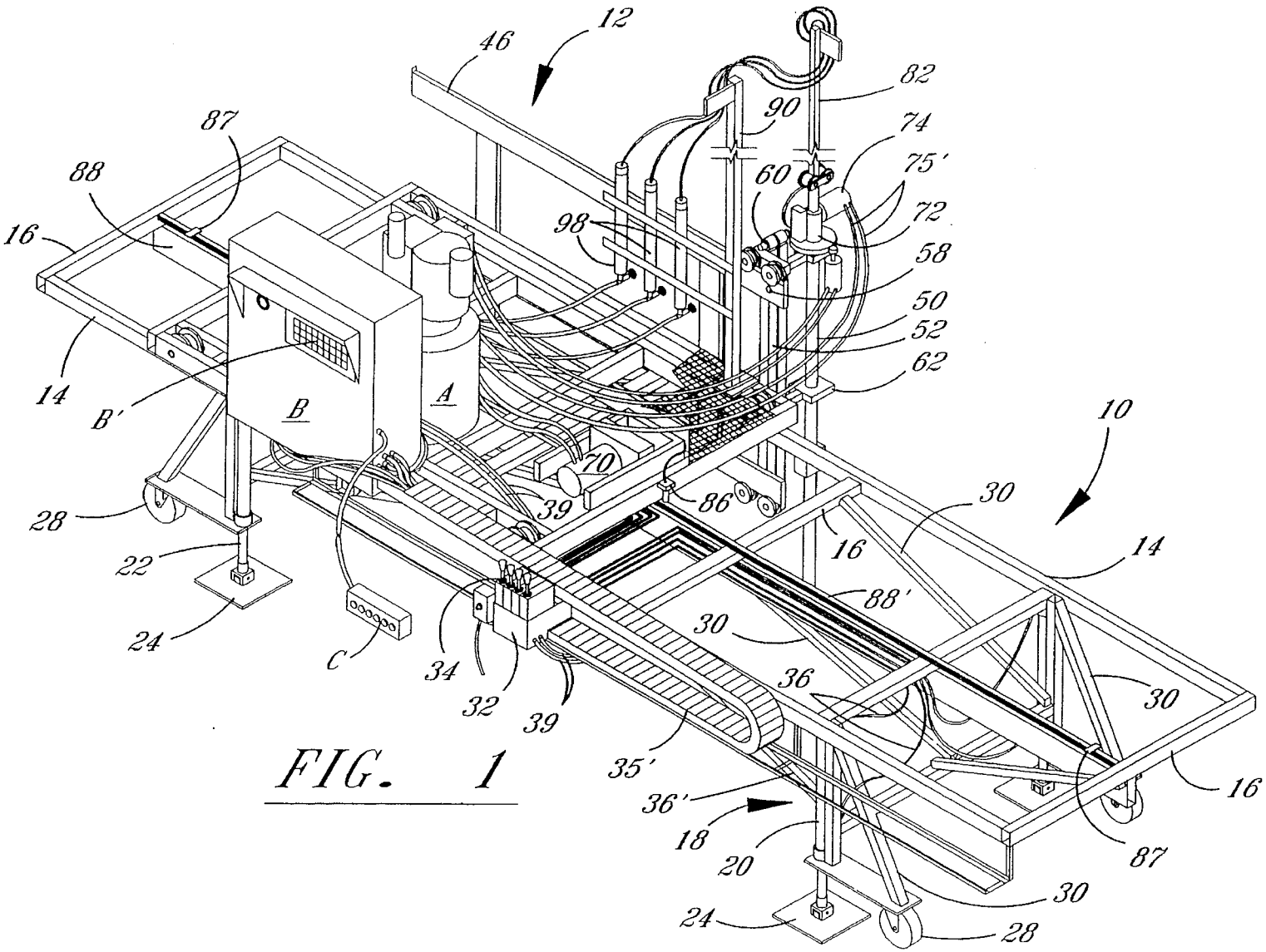
FIG. 1 is a perspective view of the automated burner system of the invention.
Figure 2:
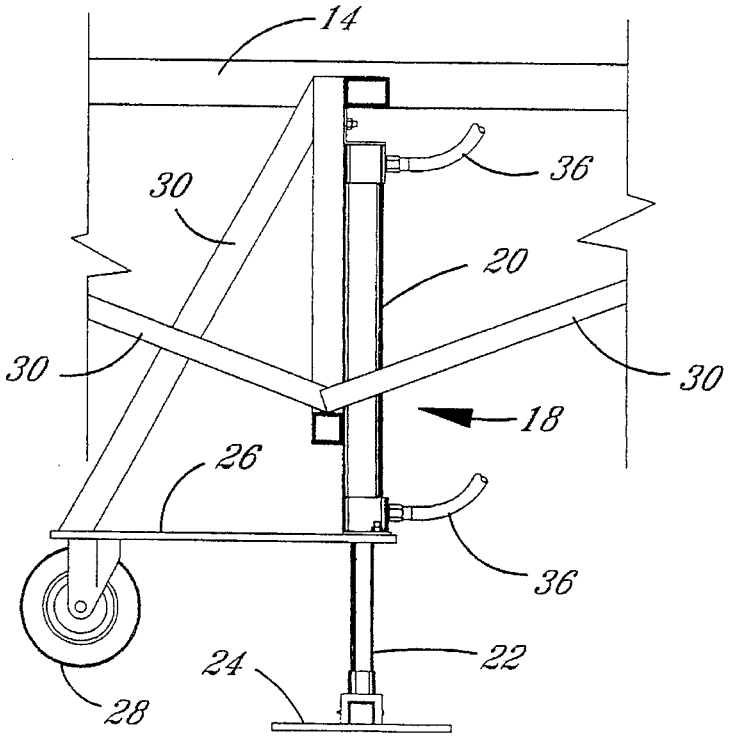
FIG. 2 is a side cutaway view of a wheel, support pod assembly for the carrying frame.
Figure 4:
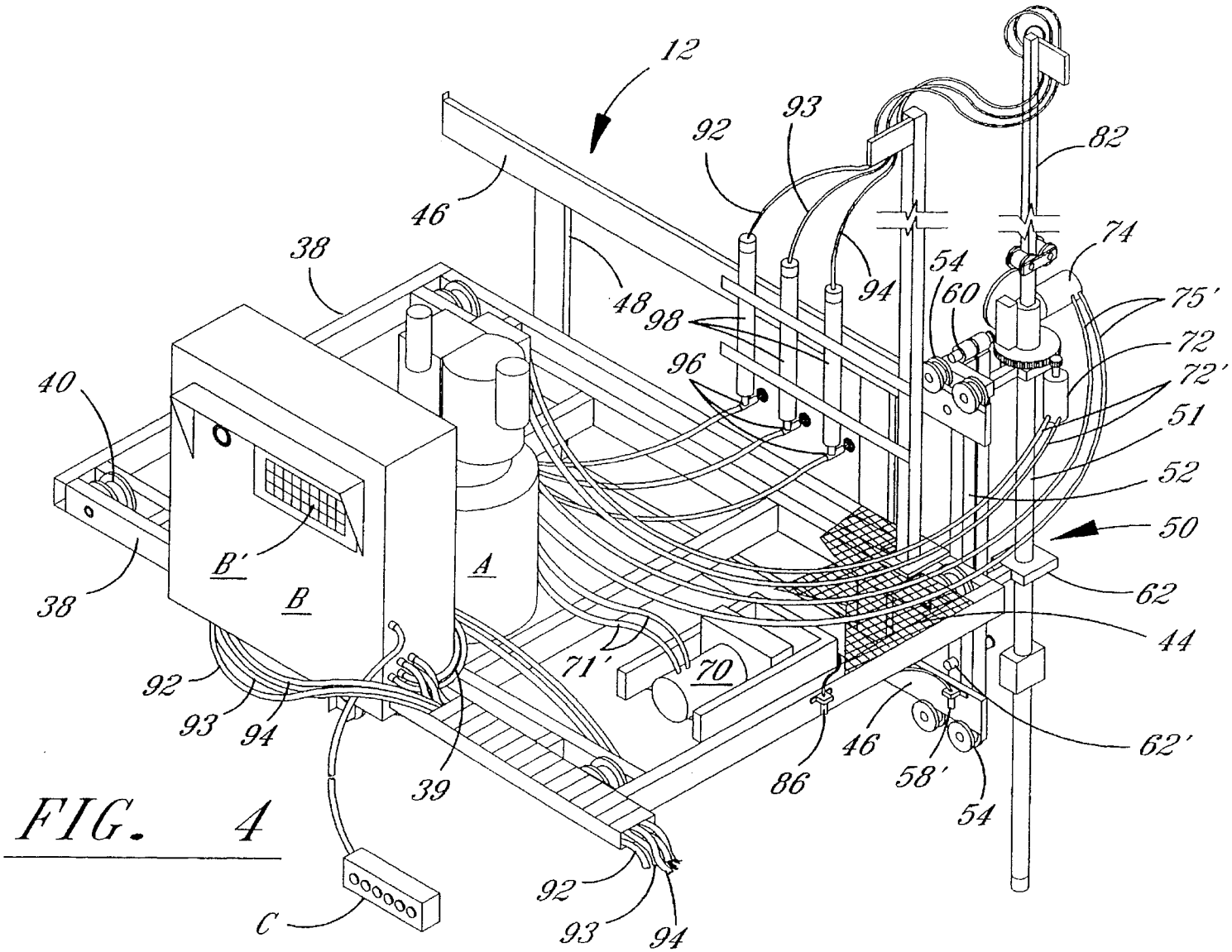
FIG. 4 is an enlarged perspective view showing the carriage assembly.

Turning now to the drawings, FIGS. 1 and 4 show the burner system of the invention. The system includes a carrying frame 10 which mounts carriage 12 for longitudinal movement along spaced parallel rails 14. Carrying frame 10 includes spaced transverse connecting rods 16 arranged longitudinally of and interconnecting rails 14. Adjacent each corner of frame 10 there is provided a vertical support leg 18 connected at one end with a rail 14 and a connecting rod 16. Leg 18, as shown in FIG. 2, consists of a piston 20 carrying a piston rod 22. A mounting pod 24 is carried by the exposed end of rod 22. A plate 26, carrying a swivel mounted roller 28, is connected at one end of piston 20. Support rods 30 are connected with the assembly to provide stability for legs 18 as shown.

A control panel 32 is connected beneath one of the rails 14. Panel 32 includes four control valves 34 each of which is connected with a pair of hydraulic lines 36 which are connected with opposite ends of pistons 20. Control valves 32 are also connected with hydraulic pump A by additional hydraulic lines 39.

Carrying frame 10 is constructed to facilitate ease of movement when the system must be moved from one location to another. To condition carrying frame 10 for movement, control valves 34 are actuated to cause pistons 20 to withdraw or elevate rods 22 carrying pods 24 into a position above the lower surface of wheels 28. Carrying frame 10 may now be rolled into the desired position.

Once positioned, control valves 34 are again controlled to cause pistons 20 to expel or move rods 22 downward until pods 24 are below the lower surface of wheels 28 and the carrying frame is elevated and supported by pods 24.

Because the work area in which the burner system operates is most times uneven, a leveling system is provided. The system includes four control valves 34 with a single valve connected with each piston 20. By individually actuating valves 34, individual piston rods 22 may be controlled to different lengths allowing legs 18 to compensate for horizontal variations over the work surface. By manipulating control valves 34, carrying frame 10 is arranged in a horizontal position along a single plane.

Carriage 12 comprises a substantially rectangular frame 38 having four support wheels 40 which are adapted to rest on rails 14 of carrying frame 10. A stabilizing wheel, not shown, which rides beneath rail 14 may also be provided on the side of carriage 12 opposite the burner assembly.

Carriage 12 is provided with a grid flooring 44 which has been cut away in FIGS. 1 and 4 to allow a clear view of the interrelationship of the various elements of the burner system. A pair of parallel and vertically spaced rods 46 are interconnected by vertical extensions 48. Extensions 48 are connected with one side of carriage frame 38 and outside of carrying frame 10 so that one of rods 46 is located below rails 14 and the other rod 46 above carriage 12.

Burner housing 50 is carried by a support structure 52 which comprises spaced pairs of support rollers 54 mounted on horizontal extensions arranged of opposite ends of a vertical arm. Spaced upper rollers 54 rest on upper rod 46 while spaced lower rollers 54 engage with the lower surface of lower rod 46. This arrangement maintains support structure 52 and burner housing 50 in a perpendicular position relative to rods 46.

Burner housing 50 is pivotally mounted on support structure 52 at 60 and is normally locked in a position aligned with the vertical arm of structure 52 by latch 62'. When the burner system is being transported, it may be desirable to position the burner housing at an angle of between 45° and 75° relative to the horizontal extension of carrying frame 10. This is accomplished by simply releasing latch 62' so that housing 50 may be rotated about pivot 60 until the desired position is achieved. When the system is again in a desired operating position, housing 50 is righted into its operating position as shown in FIGS. 1 and 4.

During operation, burner housing 50 is positioned at an extreme right or left end position along rods 46. It is locked in the selected position by a latch pin 58. This arrangement allows burner housing 50 to be positioned at an extreme end of carrying frame 10 during the initiation burning operation of a channel or at the conclusion of a burn. This capability allows the device to operate adjacent vertical walls or in corners.

Carriage 14 carries hydraulic pump A and electronic control B. Hydraulic pump A is driven by a 1½ HP electric motor and is commercially available. It operates to provide hydraulic fluid under pressure for the operation of pistons 18 and hydraulic drive motors 70, 72 and 74. Electronic control system B, which is a commercially available programmable controller or computer system is mounted on carriage 12 adjacent to hydraulic pump A. The electronic control is provided with a program of parameters. A key pad shown at B' operates in known manner to activate the desired aspects of the program to control the controller. The parameters selected are dependent upon the work situation and goal.

Figure 6:
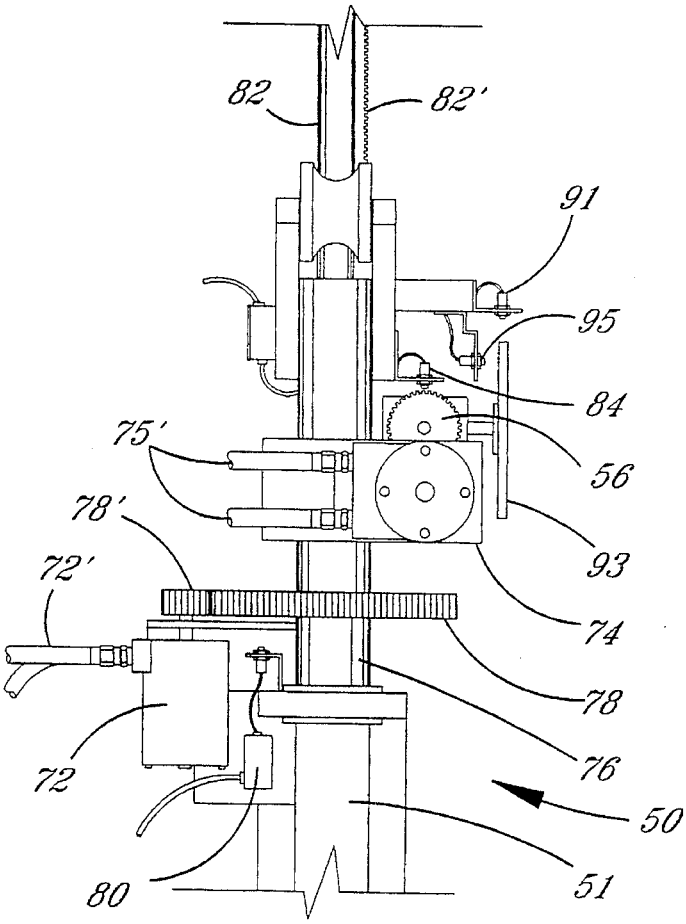
FIG. 6 is an enlarged sectional view of the burner staff drive assembly.

Burner housing 50, best shown in FIGS. 4 and 6, includes support shaft 51 which is essentially a cylindrical tube. Support shaft 51 mounts burner guide shaft 76 for oscillating movement. Guide shaft 76 is provided with drive gears 78, one of which is the drive gear of hydraulic motor 72. The motion of hydraulic motor 72 is reversed after a prescribed number of revolutions causing gears 78 to reciprocate guide shaft 76 through desired angles of oscillation. A first of a pair of proximity switches 80 (only one of which is shown) are positioned to count the number of teeth of one of gears 78. Upon counting a selected number of teeth, switch 80 signals electronic control B which is then activated to reverse the direction of drive of hydraulic motor 72 through the same number of teeth whereupon switch 80 again signals electronic control B. The second proximity switch 80 senses a marker on gear 78. This marker represents the center of the oscillating motion. Adjustment of the marker changes the angle of oscillation. Both of these control systems are known.

Burner guide shaft 76, which is also essentially a cylindrical tube, mounts burner staff 82 for vertical reciprocating motion. Burner staff 82 is formed with a gear rack 82' arranged along its length. Hydraulic motor 74 is mounted on guide shaft 76 with its drive gear 56 in engagement with the teeth of rack 82'. A limit switch 91 is located adjacent rack 82' and in position to count the teeth of gear 93 during the vertical reciprocal movement of burner staff 82. Again upon counting a designated member of teeth, limit switch 91 signals electronic control B which then acts to reverse the direction of rotation of hydraulic motor 74.

A second limit switch 95 is provided to also sense the rotation of gear 93. Limit switch 95 which also counts teeth, operates to signal electronic control B upon counting a specified number of teeth. Electronic control B is then activated to cause a pause in the motion of motor 74 and consequently a pause in the vertical movement of staff 82. There may be as many pauses as desired during each reciprocal cycle of staff 82.

Figure 3:
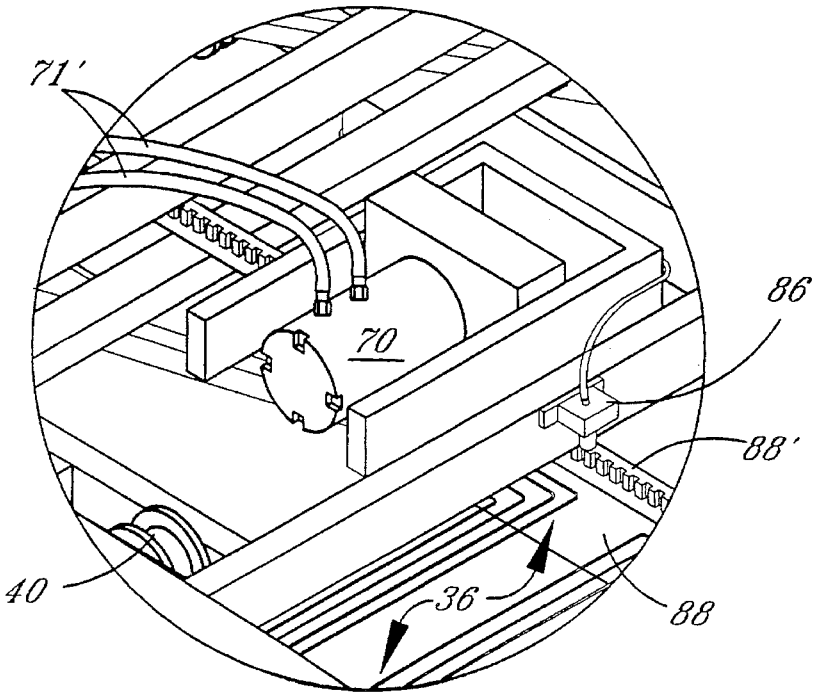
FIG. 3 is an exploded view of the carriage drive assembly.

Hydraulic motor 70 is mounted beneath floor 44 of carriage 12 as shown in FIGS. 1, 3, and 4. A beam 88 carried by carrying frame 10 is arranged intermediate of rails 46. A rack 88' is arranged along the upper surface of beam 88 with its teeth in position to engage with the teeth of the drive gear hydraulic motor 70. A pair (only one of which is shown) of limit switches 86 are carried by carriage 12 and are connected with electronic control B. Tabs 87 are constructed to be adjustably mounted along the length of beam 88 in positions to be engaged by limit switches 86 when carriage 12 has reached a selected position along carrying frame 10. Movement of carriage 12 along carrying frame 10 is selectively controlled by placing tabs 87 at desired points along rack 88. When carriage 12 moves limit switch 86 into position to detect tab 87 the electronic control B is activated to shut down of the device.

Figure 5:
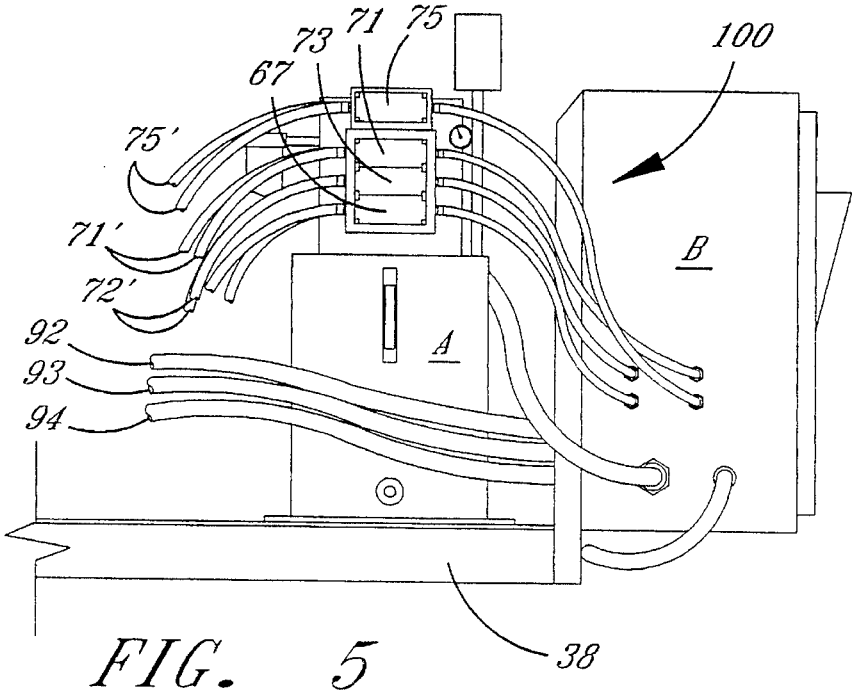
FIG. 5 is a sectional rear end view of the carriage assembly.

Hydraulic pump A as shown in FIGS. 4 and 5 is connected with control valves 67, 71, 73, and 75 which in turn are connected with hydraulic motors 70, 72, and 74 by hydraulic lines 71', 72' and 75'. Valves 71, 73, and 75 are connected with and controlled by electronic control B through electrical leads 100.

Control valves 71 and 73 are standard two way flow valves which control the direction of hydraulic flow to and from hydraulic pump A and the respective drive motors 70 and 72. Control valve 75 is an equalizer or counter balance valve which controls the flow of hydraulic fluid to and from hydraulic pump A and drive motor 74. This equalizer valve, which is commercially available, operates to maintain the hydraulic pressure in hydraulic lines 75' equal during both the upward and downward drive of burner staff 82.

Valve 67 is a pressure relief valve which operates in conjunction with pressure control valves 71, 73, and 75 to maintain the pressure constant within the hydraulic pump.

A mast 90 is secured to rods 46 adjacent to burner housing 50. Mast 90 is designed to support and maintain fuel supply lines 92, 93, and 94 in a position out of the way of the various operating motions of the burner assembly. Supply lines 92, 93, and 94 carry diesel fuel, oxygen and water respectively from a supply to the burner staff 82. Surge cylinders 98, which maintain an equal flow of fluid to the burner head (one for each supply line), are attached to upper rail 46. Control valves 96 are provided to allow the flow of fluid through lines 92, 93, 94 into the regulator cylinders 98 and on to the burner head. The fuel is supplied to the staff at its upper end where it passes through the staff to emerge at the burner head on the lower end of burner staff 82. The burner head and burner staff fuel delivery system is known and forms no part of the invention.

The program which controls electronic control B includes parameters which respond to certain conditions to control valves 71, 73, and 75 to reverse positions and to cause the burner system to function in a prescribed manner. The program provides for the electronic control through proximity switch 91 to register movement of staff 82 between upper and lower limits and upon completion of a cycle of these movements to actuate valve 71 to move carriage 12 forward an increment of movement, which is approximately one inch. The program also provides that drive motor 72 move staff 82 through a prescribed number of oscillations during each reciprocal cycle of burner staff 82 by controlling valve 73 with proximity switch 80. The length and angle of the oscillating motion is adjustable through key pad B' selecting desired parameters of the program to control electronic control B.

Electronic control B provides also electronic control to control valve 75 to reverse positions as staff 82 reaches an upper or lower limit to cause hydraulic motor 74 to reverse its drive direction and move staff 82 in an opposite direction. This cycle repeats upon staff 82 reaching its upper and lower limit.

Electronic control B is also programmed with a safety control. During normal operation, drive motor 74 reciprocates burner staff 82 between upper and lower limits. Should the burner end strike a protrusion in the channel during a downward stroke drive motor 74 will stall. Limit switch 84 is provided to monitor movement of gear 56. Upon an indication of stall or gear 56 prematurely coming to a stop, limit switch 84 signals electronic control B which then switches control valve 75, which reverses temporarily drive motor 74 to raise burner staff 84 slightly while simultaneously switching valve 71 to cause drive motor 70 to move carriage 12 rearwardly an increment, usually one half inch. Electronic control B is then controlled to again switch valve 75 to again reverse motor 74 and begin movement of burner staff in its downward stroke towards its lower position. Should staff 82 again fail to complete the downward stroke the electronic control deactivates the burner system.

This burner system is capable of burning a channel which is 17' deep and 20' long per set up. The system will channel over 18 sq. ft. per hour at a cost of 75 cents per sq. ft.

At times it becomes desirable to operate the system by hand. A manual control C is connected with the electronic control. Manual control C includes override switches which override the electronic control for selected operations. There are a pair of override switches for each of valves 71, 73, and 75 which allow for the manual control of motors 70, 72, and 74 in both directions.

While a preferred embodiment of the invention has been described using specific terms, such description is for illustrative purposes only, and it is to be understood that changes and variations may be made without departing from the spirit or scope of the following claims.

What is claimed is:

1. An automated burner system for channeling a mineral body, said system comprising:

a burner staff carrying a burner at one end;

a guide shaft adapted to carry said burner staff for reciprocating motion;

a support shaft adapted to mount said guide shaft for oscillating motion;

a carriage adapted to carry said support shaft;

a carrying frame comprising a pair of spaced parallel rails, said carrying frame being adapted to carry said carriage for longitudinal movement along said rails;

a first drive providing positive reciprocal movement of said burner staff;

a second drive providing positive oscillating movement for said guide shaft and said burner staff;

a third drive providing positive longitudinal movement of said carriage burner staff along said carrying frame; and an electronic control connected with said first drive, said second drive and said third drive, said electronic control including a repeating program causing said first drive to move said burner staff a desired distance in each direction of reciprocal movement, causing said second drive to oscillate said burner staff at a prescribed angle and through a prescribed length of oscillation, and causing said third drive to move said carriage and said burner staff longitudinally along said carrying frame upon completion of one cycle of movement of said reciprocating and oscillating movements; whereby said burner system operates in an automatic continuous and repetitive manner.

2. The system of claim 1 wherein said electronic control is mounted on said carriage.

3. The system of claim 1 further including a hydraulic system, said hydraulic system being carried by said carriage.

4. The system of claim 3 wherein said hydraulic system includes a hydraulic pump and a plurality of flow valves.

5. The system of claim 3 wherein said first drive, said second drive and said third drive each comprise a hydraulic motor having a rotably driven drive gear, said hydraulic motors being connected with said hydraulic system.

6. The system of claim 1 wherein said spaced parallel rails of said carrying frame are united at least at opposite ends with cross members, said carrying frame includes a plurality of wheels which allow for ease of movement when said system is not operational and a plurality of support pods which stationarily support said carrying frame in a horizontal position when said system is operational, said pods normally being in an elevated position when said system is not operational.

7. The system of claim 6 where said carrying frame mounts one of said pods adjacent each corner thereof, each of said pods including a vertically adjustable member; whereby individual adjustment of said adjustable members allows for horizontal positioning of said carrying frame.

8. The system of claim 7 wherein said wheels are elevated when said pods are in supporting positions.

9. The system of claim 7 wherein said vertically adjustable member comprises a hydraulic cylinder having a reciprocal piston mounting a shoe on one end thereof;

a control system including a hydraulic supply and a control valve connected with each hydraulic cylinder; whereby, said pods may be vertically adjusted by adjusting the position of said piston within said cylinder with said control system.

10. The system of claim 6 wherein said carrying frame includes a rack, said third drive engaging said rack for facilitating longitudinal movement of said carriage along said carrying frame.

11. The system of claim 1 further including a manual control panel connected with said electronic control, said manual panel having control switches which are operative to selectively interrupt said repeating program; whereby, said electronic control may be interrupted and said burner system controlled through desired of its motions by hand.

12. The system of claim 1 wherein said electronic control includes a plurality of proximity switches, said proximity switches being positioned to monitor said first, second and third drives and being connected to actuate said electronic control to control said first, second and third drives through their programmed movements.

13. The system of claim 1 wherein said carriage includes a pair of spaced horizontal rods arranged parallel of said rails; and a burner housing mounted on said rods for selective longitudinal between opposed ends thereof, said burner housing carrying said support shaft.

14. The system of claim 13 wherein said burner housing includes an operative position which mounts said support shaft vertically and a carrying position which mounts said support shaft at between 30° and 50°.

15. The system of claim 1 wherein said burner is an oxygen burner.

16. The system of claim 1 wherein said electronic control includes a pressure sensing system connected with said first drive, said pressure sensing system becoming activated upon sensing excessive pressure against said first drive during reciprocal movement of said burner staff, said pressure sensing system being operative to actuate said electronic control to control said first drive to elevate said burner staff and said third drive to move said carriage rearward one increment whereupon said electronic control controls said first drive and said third drive to begin anew the cycles of motion.

17. An automated burner system for channeling a mineral body comprising:

a carriage carrying a burner assembly, a hydraulic system and an electronic control system, said electronic control system being connected with said burner assembly and said hydraulic system;

said burner assembly including a staff carrying a burner head at one end and a staff guide adapted to carry said staff for reciprocal vertical movement;

a staff drive including a staff drive motor rotatable in first and second directions for reciprocally and positively driving said staff between vertically spaced upper and lower limits;

a carriage drive including a carriage drive motor rotatable in first and second directions, said carriage drive motor incrementally driving said carriage in forward and rearward directions;

a proximity switch connected with said electronic control system and arranged to scan said staff drive, said switch functioning to control the direction of said staff drive motor between said first and second directions of rotation by counting gear teeth; whereby said system functions in normal operation with said staff drive motor rotating in said first and second directions to move said staff between lower and upper limits, said proximity switch counting gear teeth of said staff drive through a prescribed number of teeth in each direction and signaling said electronic control system which reverses direction of said staff drive motor after passage of a prescribed number of teeth;

said electronic control system activating said carriage drive motor through an increment of forward drive upon said staff cycling through said upper and lower limits of motion;

a second proximity switch functioning to sense movement of said staff motor, said second proximity switch signalling said electronic control system upon an indication of said staff drive motor stalling prior to said staff reaching one of said upper and lower limits, said electronic control being activated to reverse the direction of drive of said staff motor upon said second proximity switch sensing staff drive motor stall to return said staff to said upper or lower limit; and upon return of said staff to said upper or lower limit said electronic control system activating said staff drive motor to again move said staff between said upper and lower limits.

18. The system of claim 17 wherein said electronic control system is operative to deactivate said burner system upon receiving consecutive sensings of said staff drive motor stall.

19. The system of claim 17 including a third drive motor connected with said electronic control system;

a third drive, including gears having teeth, connecting said third drive motor with said staff guide, said third drive motor being operative to drive said staff guide and said staff through oscillating motion.

20. The system of claim 17 including a third proximity switch connected with said electronic control said third proximity switch acting to count teeth of said third drive and upon counting a selected number acting to signal said electronic control to reverse rotational direction of said third motor.

21. The system according to claim 17 wherein said electronic control, upon being signaled of an incomplete cycle of said staff drive motor, further acts to activate said carriage drive motor in said rearward direction through an increment of drive.

22. An automated burner system for channeling a mineral body comprising:

a carriage carrying a burner assembly, a hydraulic system and an electronic control system, said electronic control system being connected with said burner assembly and said hydraulic system;

said burner assembly including a burner staff and a staff guide adapted to carry said staff for reciprocal vertical movement;

a staff drive rotatable in first and second directions for reciprocally driving said staff between vertically spaced upper and lower limits;

a carriage drive rotatable in first and second directions, said carriage drive incrementally driving said carriage in forward and rearward directions;

said hydraulic system including a hydraulic pump connected with said staff drive and said carriage drive, said hydraulic pump being operative to drive said staff drive and said carriage drive in said first and second directions; and said electronic control system being operative to control said hydraulic system to selectively and automatically drive said staff and carriage drives in said first and second directions; whereby automatic channeling is performed by said burner system.

23. The system of claim 20 including a staff guide drive rotatable in first and second directions and driven by said hydraulic pump, said electronic control being operative to control said hydraulic system to selectively drive said staff guide in said first and second directions to drive said burner staff guide and burner staff reciprocally.

* * * * *